United States Patent [19]

Klinedinst

[11] 4,118,208

[45] Oct. 3, 1978

[54] DISCHARGE MEANS FOR CANISTER VACUUM CLEANER

[76] Inventor: George Lewis Klinedinst, 964 N. George St., York, Pa. 17404

[21] Appl. No.: 790,542

[22] Filed: Apr. 25, 1977

[51] Int. Cl.[2] ..... B01D 35/16

[52] U.S. Cl. ..... 55/433; 55/472; 55/DIG. 3; 251/100; 251/147; 251/324

[58] Field of Search ..... 55/433, 432, 472, DIG. 3; 251/147, 100, 324

[56] References Cited

U.S. PATENT DOCUMENTS

| | | | |
|---|---|---|---|
| 1,041,626 | 10/1912 | Hess | 251/147 X |
| 1,063,438 | 6/1913 | Harlan | 251/147 |
| 1,278,813 | 9/1918 | Weaver | 251/147 X |
| 1,594,204 | 7/1926 | Kingham | 251/147 |
| 1,654,476 | 12/1927 | Amend | 251/147 |
| 2,471,326 | 5/1949 | Hoyt, Sr. | 55/433 X |
| 2,642,894 | 6/1953 | Burnett | 251/100 X |
| 2,763,459 | 9/1956 | Anderson | 251/100 X |
| 2,943,698 | 7/1960 | Bishop | 55/DIG. 3 X |
| 2,986,370 | 5/1961 | Girton | 251/100 |
| 3,256,680 | 6/1966 | Coombs | 55/472 X |
| 3,320,727 | 5/1967 | Farley et al. | 55/DIG. 3 X |
| 3,618,297 | 11/1971 | Hamrick | 55/DIG. 3 X |
| 3,621,641 | 11/1971 | Takei et al. | 55/DIG. 3 X |

FOREIGN PATENT DOCUMENTS

| | | | |
|---|---|---|---|
| 254,740 | 3/1970 | U.S.S.R. | 55/433 |

*Primary Examiner*—Frank W. Lutter
*Assistant Examiner*—Kathleen J. Prunner
*Attorney, Agent, or Firm*—C. Hercus Just

[57] ABSTRACT

A canister type vacuum cleaner having cylindrical walls and a bottom therein supporting at the upper open end thereof a suction type blower and filter is provided with discharge means attachable to the bottom of the canister and including a transverse slide adapted to close an opening formed in a supporting plate for the slide and an additional coaxial opening which is to be formed in the bottom of the canister, the canister also including a conical, funnel-like deflector having a central opening coaxial with the opening in the bottom of the canister, the slide forming a closure which is spring-pressed in closing direction and including a manipulating handle and an end which may be operated when the slide is in open position to maintain the same in said position to facilitate emptying the canister from the bottom thereof without requiring removal of the suction head and dumping of the canister.

3 Claims, 3 Drawing Figures

DISCHARGE MEANS FOR CANISTER VACUUM CLEANER

BACKGROUND OF THE INVENTION

Canister type vacuum cleaners, per se, are well-known and comprise a cylindrical container which frequently has a diameter substantially equal to the height thereof. The bottom of the canister is closed and the open upper end of the canister supports a closure member which actually comprises a suction unit including a suitable suction fan which draws air through an opening in the sidewall of the canister up through a filter member, and discharges the air from the upper portion of the suction unit. The suction unit is supported by the upper end of the canister by suitable latching means and when it is desired to empty the canister, it is necessary to detach the suction head from the upper end of the canister and then dump the canister.

In general, slidable, gate-type valve means are used in many types of structures, especially in valves intended to control the flow of fluids in conduits but, as far as is known, canister type vacuum cleaners have not heretofore employed any type of discharge means in the bottom of the canister, either those employing gate-type valves or otherwise.

SUMMARY OF THE INVENTION

It is among the principal objects of the present invention to provide a canister type vacuum cleaner with discharge means to facilitate emptying the canister, said discharge means being attachable to either newly manufactured or previously manufactured vacuum cleaners and, in the preferred construction of the invention, such discharge means may be sold in the form of a kit attachable to either new or previously manufactured vacuum cleaners, said kit also including a funnel-shape deflector member insertable in the lower portion of a vacuum cleaner and having an opening in the lower end thereof which is coaxial with a discharge opening to be formed in the bottom of the canister, as well as a discharge opening or port formed in a supporting plate which is attachable to the bottom of the canister for mounting a slide-type closure member for said discharge openings.

It is another object of the invention to provide the slidable closure member with an operating rod that is associated with a spring that normally biases the closure member in a closing direction, and said operating rod projects beyond one outer edge of the bottom of the canister for purposes of manipulating the closure member and, when desired, also to hold the closure member in open position, such as during emptying of the canister.

One of the principal advantages of the present invention resides in the fact that in order to empty the canister, it is unnecessary to disturb the suction head on the upper end thereof and merely support the assembled canister and suction head over a receptacle such as a trash can, move the closure member along the bottom of the canister to open position, and permit gravity to discharge the accumulated material in the canister into such refuse receptacle.

DETAILED DESCRIPTION

Figure 1:
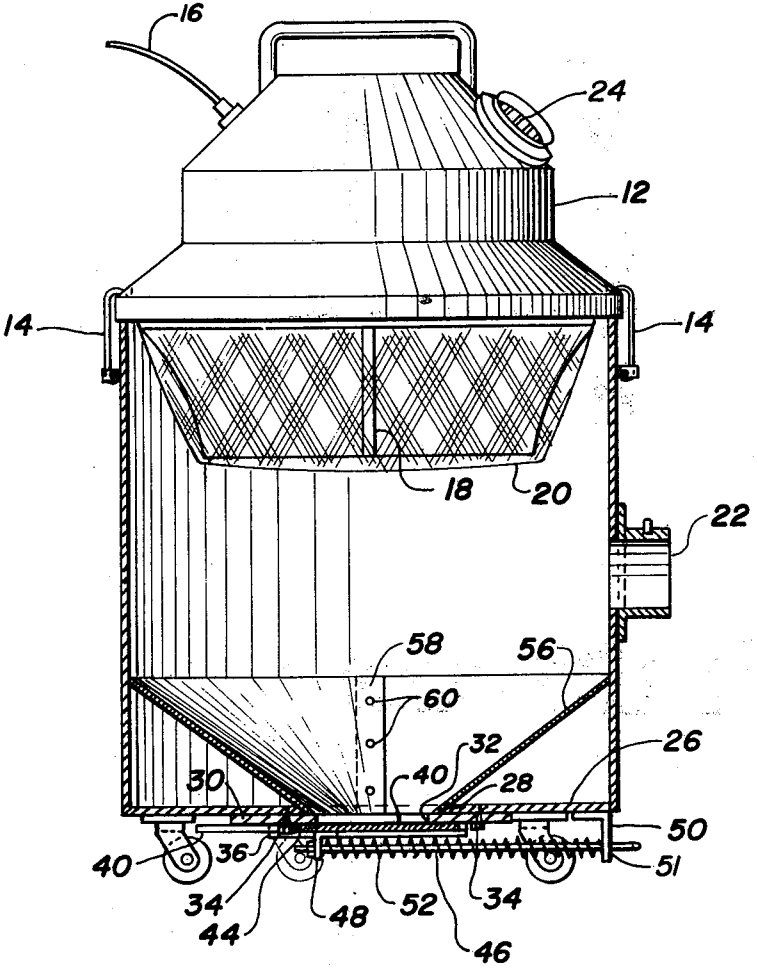
FIG. 1 is a vertical elevation of a typical canister type vacuum cleaner and showing in full side view in the upper portion thereof, a vacuum head mounted upon the upper end of a vertical canister which is illustrated in vertical section for purposes of showing details of the discharge means connected to the bottom of said canister, said sectional view of the canister being substantially along the line 1—1 of FIG. 2.

Referring to the drawing, especially FIG. 1, there is illustrated therein in vertical section, a canister or pot-type vacuum cleaner 10, the upper end of which is open but, in use, normally is closed by a suction head 12, which actually comprises a cover and is maintained over said open end of the canister 10 by suitable clamp members 14. The suction head 12 also includes a suction fan operated by an electric motor which is supplied with current by a conventional electric cord 16.

The inlet end of the suction head 12 which is on the bottom thereof usually includes a suitable supporting frame 18 over which a porous filter member 20 extends. The canister 10 also is provided in one side thereof with an inlet port 22 through which air is drawn by the suction head and, after the filter 20 separates dust and other particulate material from the incoming air, discharges the filtered air through a discharge port 24 formed in the suction head 12.

Under normal circumstances, when it is desired to empty the canister 10 to discharge the accumulated material therein, it is necessary to release the clamp members 14 in order that the suction head 12 may be removed from the upper end of the canister 10, after which the canister can be dumped into a suitable receptacle, such as a trash can or other similar means. It has been found to be inconvenient to always have to remove the suction head 12 in order to effect such discharge of accumulated material from the canister 10, and hence, the present invention has been developed to eliminate the need to remove the suction head 12 from the canister 10 incident to effecting complete discharge of accumulated material therein from the canister, details of said discharge means being as follows:

The discharge means comprising the present invention is attachable to the normal bottom 26 of the canister 10. Incidentally, canisters of the type to which the present invention pertains normally are cylindrical but the invention is not restricted to that particular shape of canister. Under circumstances where the discharge means of the invention are to be attached to an existing canister 10, a central discharge opening 28 is formed in the bottom 26, and under circumstances where said discharge means is to be attached to newly manufactured vacuum cleaners, the bottom 26 of the canisters 10 also are provided with a similar opening 28, incident to manufacturing the same.

Figure 2:
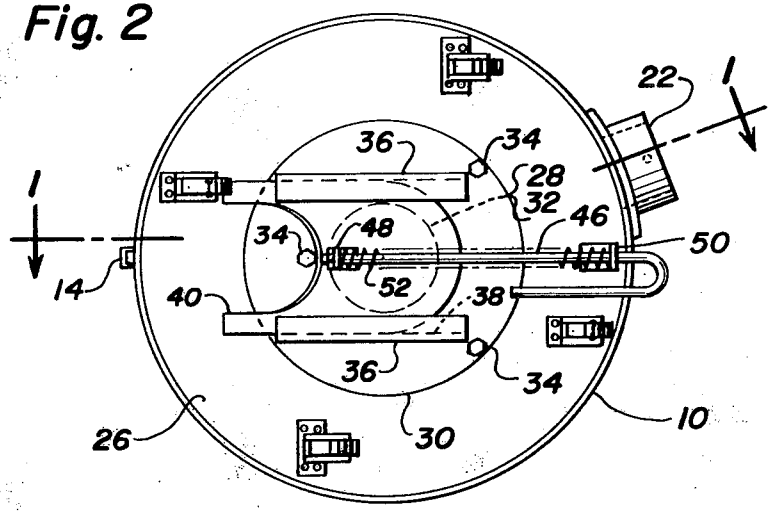
FIG. 2 is a bottom plan view of the canister shown in FIG. 1 and illustrating details of the discharge mechanism, the closure member thereof being shown in closed position in said figure.
Figure 3:
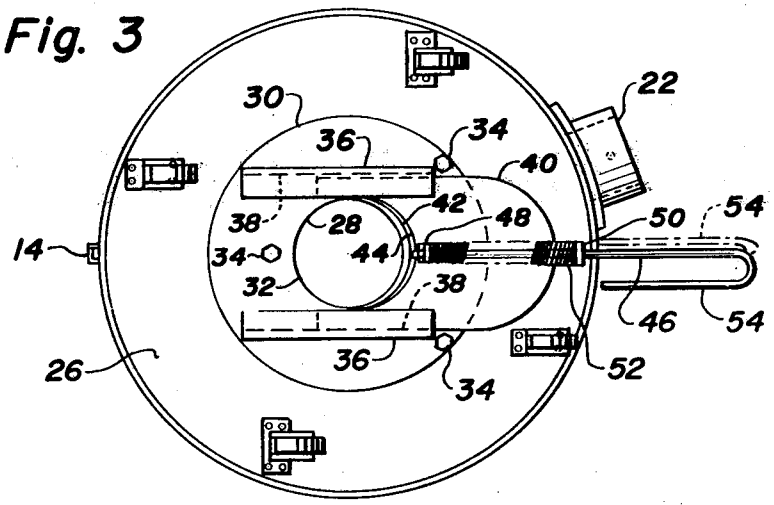
FIG. 3 is a bottom plan view similar to FIG. 2 and illustrating the closure slide in open position and, in phantom, showing one end of a manipulator member in position in which said member is capable of maintaining the closure slide in open position.

Referring to FIGS. 2 and 3, the discharge means comprises a mounting plate 30 which may be formed from suitable sheet metal or otherwise, and said plate is also provided with a central discharge opening 32 which preferably is of corresponding size to the discharge opening 28 formed in the bottom 26 and is coaxial therewith. The mounting plate 30 is readily attached firmly to the lower surface of the bottom 26 by any suitable means such as a plurality of bolts or screws 34. The mounting plate 30 also supports a pair of similar guide channels 36 which, if desired, may be in the form of angle members welded along the edge of one flange to the lower surface of the mounting plate 30 to support the opposite flange thereof in spaced parallel relationship to the plate 30 and, thus, form a pair of similar guideways 38, which respectively support the opposite edges of a slidable cut-off closure slide 40, which is in close slidable engagement with the lower surface of the mounting plate 30. The innermost end 42 is a concave arc and preferably a semi-circle about a radius which is equal to half the diameter of the discharge openings 28 and 32. Also, said innermost end 42 is sharpened as shown by the small bevel 44 in FIG. 1, for the obvious purposes of providing a shearing edge and thereby readily facilitating the removal of any accumulation of debris or other waste material which may accumulate on the rim of the discharge opening 32, when, during emptying of the canister 10, it is positioned over the upper end of a suitable waste receptacle, such as a trash can or otherwise.

The closure slide 40 is actuated by means of an actuating rod 46 which is pivotally connected at the innermost end to a connecting means comprising a depending ear 48. A guide bracket 50 has an aperture 51 through the depending leg thereof for slidably accommodating the actuating rod 46, the bracket 50 being L-shaped or otherwise and the same is securely fastened to the bottom 26 of canister 10, incident to installing the discharge means thereon, or to plate 30.

A coiled compression spring 52 surrounds the rod 46 and extends between the ear 48 and the bracket 50, the strength of the spring being such that it normally urges the closure slide 40 to closed position relative to the discharge openings 28 and 32.

When it is desired to empty the canister 10, as indicated above, it is lifted so as to be disposed directly over a suitable refuse collector or receptacle, following which the outer end of the actuating rod 46, which normally extends beyond the rim of the bottom 26 and serves as a handle, is pulled outwardly to remove the closure slide 40 from closing engagement with the discharge openings 28 and 32. For purposes of maintaining the closure slide 40 in such open position, the present invention contemplates the outer end 54 of the actuating rod 46 being bent upon the main portion of the rod in the manner illustrated in FIGS. 2 and 3 and, when the rod 46 is rotated about its axis to dispose the outer end 54 in the phantom position thereof shown in FIG. 3, for example, the terminal end of the outer end 54 may engage either the rim of the bottom 26 or the lower portion of the sidewall of canister 10, depending upon the space between the end 54 and the main portion of the rod, as viewed in FIGS. 2 and 3, or if the space is sufficiently small, the terminal end of the outer end 54 may abut the bracket 50 and thereby hold the closure in the open position shown in FIG. 3 for a period as long as desired.

To facilitate emptying the interior of the canister 10, the present invention also contemplates the inclusion of a funnel-shaped conical deflector 56, which may be formed from sheet metal and in the event the same is included in a kit-type of discharge means to be attached to existing vacuum cleaners, the deflector 56 may be in flat form and is subsequently arranged in conical configuration by overlapping the short radial ends 58 and securing the same by appropriate screws or rivets 60, as shown in FIG. 1. Preferably, the upper edge of the deflector member 56 is co-extensive with the inner sidewalls of the canister 10 so as to prevent the escape of waste material between said upper edge and the sidewalls and thereby efficiently serve as a deflector to direct waste material through the discharge openings 28 and 32 when the closure slide 40 is in the position shown in FIG. 3. Similarly, the deflector 56 may be installed in newly manufactured vacuum cleaners and secured therein by any appropriate means, such as epoxy cement or otherwise, or simply by friction between the upper rim and the inner wall of the canister 10.

From the foregoing, it will be seen that the present invention provides a very simple, yet highly effective and convenient means for emptying the contents of the canister of a canister type vacuum cleaner without requiring the same to be disassembled in any way, as distinguished from the requirement of removing the suction head from conventional canisters in order to effect dumping off the contents of the canister from the upper end thereof. Further, by disposing the canister 10 over the upper end of a refuse receptacle of similar diameter, it will be seen that there is no possibility for the material being emptied to raise dust which is discharged from the upper end of the waste receptacle as is now occasioned incident to dumping conventional canisters having no such discharge means. Simply by letting the canister remain over the waste receptacle for a short period of time, the dust will settle, after which the canister 10 and its assembled suction head 12 may be removed from the waste receptacle and after the closure slide 40 is moved to closed position, the vacuum cleaner is in condition to perform its normal functions of accumulating additional refuse material introduced thereto by the suction means of the vacuum cleaner.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. Discharge means for use with a canister type vacuum cleaner having a canister which detachably supports a suction head at the upper end thereof and having a bottom at the lower end of said canister in which a circular opening is formed, said discharge means comprising in combination, a mounting plate having a central circular opening similar in size to said opening in the bottom of said canister and positioned coaxially therewith, means adapted to secure said plate firmly to the lower surface of said bottom with said openings in registry, a pair of parallel guide channels connected to the surface of said plate opposite the surface mounted against said bottom of said canister and each guide channel respectively positioned adjacent opposite sides of said central opening, a cut-off closure slide supported between said guide channels for close sliding engagement with the surface of said plate to which said channels are connected and having one end which moves toward and from said opening in said mounting plate, an actuating rod, connecting means on said one end of said slide to which one end of said rod is connected and the other end of said rod comprising an outer end extending beyond the periphery of the bottom of said canister for manual engagement, a spring mounted upon said rod, a bracket adapted to be fixed to said bottom of said canister adjacent the outer edge thereof and having a leg depending therefrom and provided with an aperture through which the outer end of said actuating rod extends, said spring on said rod extending between said leg and said connecting means on said one end of said slide and operable to move said slide from open to closing position over said opening in said plate, and the edge of said slide which moves toward and from said opening in said plate being in the form of a concave arc similar to a segment of the circumference of the circular opening in said mounting plate and said arcuate edge of said slide being bevelled to constitute a sharpened shearing edge cooperable with the perimeter of said central opening in said plate to remove any accumulated material extending through said opening.

2. The discharge means according to claim 1 in which said connecting means on said one end of said slide comprises a depending ear adjacent said one end of said slide, said one end of said actuating rod being connected to said depending ear on said slide and said spring being a coiled compression spring surrounding said rod and extending between said depending ear and depending leg of said bracket to effect movement of said slide in closing direction due to expansion of said spring.

3. The discharge means according to claim 2 in which said outer end of said rod has a portion reversely bent onto the rod and extending therealong a predetermined distance toward said one end of said rod, said one end of said rod being rotatably secured to said depending ear and the terminal end of said reversely bent end portion of said rod being adapted to abut the lower portion of the sidewall of said canister when said slide is extended to open position relative to said opening in said plate and said rod is rotated about its axis to effect such abutment and thereby maintain said slide in said open position.

* * * * *